United States Patent [19]

Nichols

[11] Patent Number: 4,519,633

[45] Date of Patent: May 28, 1985

[54] SUBSEA WELL CASING TIEBACK CONNECTOR

[75] Inventor: Randy P. Nichols, Humble, Tex.

[73] Assignee: FMC Corporation, Chicago, Ill.

[21] Appl. No.: 509,127

[22] Filed: Jun. 29, 1983

[51] Int. Cl.[3] ..... F16L 37/08

[52] U.S. Cl. ..... 285/3; 166/217; 285/18; 285/317; 285/321

[58] Field of Search ..... 285/3, 4, 18, 317, 321; 166/139, 217

[56] References Cited

U.S. PATENT DOCUMENTS

| | | | |
|---|---|---|---|
| 3,499,665 | 3/1970 | Conrad | 285/3 |
| 3,863,715 | 2/1975 | Yonker | 166/217 |
| 4,019,760 | 4/1977 | Streit | 285/3 |
| 4,161,984 | 7/1979 | Watkins | 166/217 X |
| 4,248,300 | 2/1981 | Braddick | 166/217 X |
| 4,457,368 | 7/1984 | Knierimen et al. | 285/3 X |

*Primary Examiner*—Cornelius J. Husar
*Assistant Examiner*—Eric S. Katz
*Attorney, Agent, or Firm*—W. W. Ritt, Jr.; Richard B. Megley

[57] ABSTRACT

A pipe connector especially useful in tying back to a subsea wellhead with a marine riser. The connector comprises a body or sub, a collar surrounding the sub and carrying anti-rotation keys and a lock ring, and an actuator nut surrounding and threaded to the sub. The anti-rotation keys prevent rotation of the collar and the nut with respect to the receptacle into which the connector is run, and rotation of the sub with respect to the collar and nut locks the connector into the receptacle and establishes a metal-to-metal seal therewith.

16 Claims, 5 Drawing Figures

SUBSEA WELL CASING TIEBACK CONNECTOR

BACKGROUND OF THE INVENTION

This invention relates to pipe connectors, and more particularly to connectors for tying back to subsea wellheads with casing, tubing or other pipe risers.

Conventional practice in developing offshore petroleum deposits is to drill a number of production wells from a drilling platform and then cap the wells at the ocean floor until a production platform has been installed at the surface. In order to commence production from such a subsea well, marine riser pipe is run from the production platform and connected to the subsea wellhead, a procedure generally referred to as tying back to the wellhead, and various types of tieback connectors are available for this purpose.

The present invention provides several improvements in the tieback connectors known at this time.

SUMMARY OF THE INVENTION

The present invention comprises a pipe connector having particularly advantageous utility as a tieback connector for subsea wellheads.

A connector according to the instant invention facilities tying back or otherwise connecting a casing riser or other pipe to a subsea wellhead or other remote receptacle, and establishing therewith a pressure-tight metal-to-metal seal, usually with a casing hanger in the wellhead. The described connector includes a body or sub with threads to attach it to a riser pipe, a collar surrounding the sub and carrying anti-rotation keys near its upper end and an expandable lock ring near its lower end, and an actuator not surrounding and threaded to the sub and anti-rotationally connected to the collar. The anti-rotation keys cooperate with slots in the receptacle to prevent rotation of the collar when the connector is installed, whereby rotation of the riser at the surface causes rotation of the sub with respect to the collar and actuator nut, resulting in axial movement of the sub and collar relative to the nut, expansion of the lock ring into a groove in the receptacle, and establishing a metal-to-metal seal between the lower end (nose) of the sub and an internal stop shoulder in the receptacle.

DESCRIPTION OF THE PREFERRED EMOBODIMENT

Figure 1:
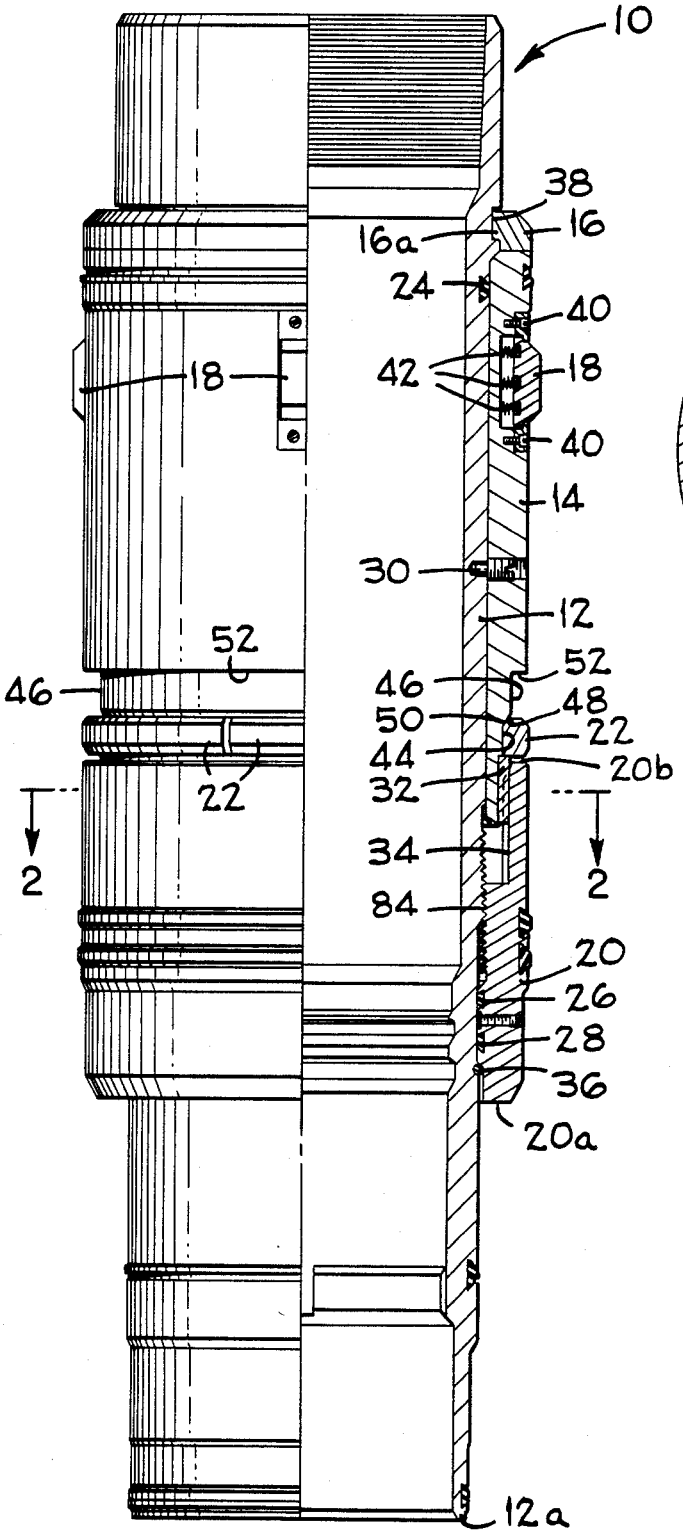
FIG. 1 is a side elevation, the right half in section and the left half in full, of a subsea well casing tieback connector to the present invention.
Figure 2:
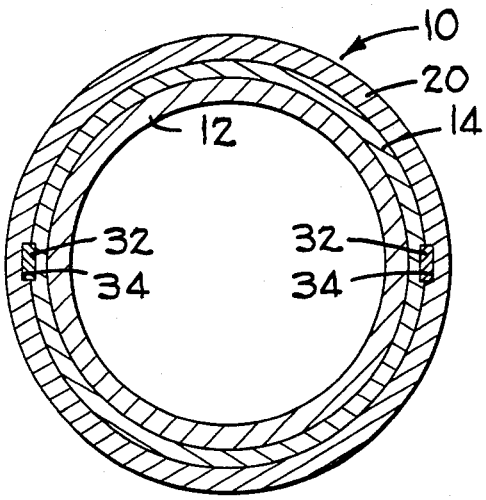
FIG. 2 is a view taken along the line 2—2 of FIG. 1.

FIGS. 1 and 2

As shown best in FIGS. 1 and 2, a tieback connector 10 according to the present invention comprises an assembly of a tubular shaped tieback sub 12, an anti-rotation collar 14 surrounding the sub 12, a pair of semi-circular collar retainer ring segments 16 removably secured to the upper end of the collar 14 as by bolts or cap screws (not shown), four anti-rotation keys 18 (only three shown) circumferentially spaced about and extending outwardly from the collar 14, an actuator nut 20 surrounding and in threaded engagement with the sub 12, and an axially-split expandable lock ring 22 surrounding the sub 12 above the nut 20. An annular resilient seal 24 provides a fluid pressure barrier between the sub 12 and the collar 14, and the same function between the sub 12 and the nut 20 is performed by annular resilient seals 26,28. A shear pin 30 prevents relative rotation between the sub 12 and the collar 14, and a pair of anti-rotation keys 32 on the outer surface of the collar 14 cooperate with a pair of longitudinal slots 34 on the inner surface of the nut 20 to prevent relative rotation, yet facilitate relative axial movement, between the collar and the nut. A snap ring 36, residing in an external annular groove on the sub 12 near the lower end of the actuator nut 20, prevents unintentional removal of the nut from the sub.

As shown in FIG. 1, each of the retainer ring segments 16 has an inwardly extending flange-like portion 16*a* that resides in an external annular groove 38 on the sub 12 to prevent relative axial movement between the collar 14 and the sub. The anti-rotation keys 18, which as explained later prevent rotation of the collar 14 with respect to a wellhead or other receptacle in which the connector 10 is installed, are secured to the collar 14 by cap screws 40 in a manner that permits radial movement of the keys with respect to the collar, and a plurality of coil springs 42 bias the keys toward their illustrated outermost position.

The lock ring 22 resides in inherently contracted position against an annular axial surface 44 on the exterior of the collar 14 just above the actuator nut 20. On the collar 14 above the surface 44 is another annular axial surface 46 of significantly larger diameter than the surface 44, and an annular beveled cam surface 48 extends upwardly and outwardly between the surfaces 44,46. The upper inner edge of the lock ring 22 is chamfered to form a cam surface 50 that cooperates with the collar's cam surface 48 to cause expansion of the ring as the collar moves axially downward with respect to the actuator nut 20 during rotation of the sub 12 to lock the connector 10 into a wellhead, as will be explained later. Extending outwardly from the upper end of the annular surface 46 is a radial stop surface 52 that functions to prevent further relative axial movement between the collar 14 and the lock ring 22.

FIGS. 3-5

Figure 3:
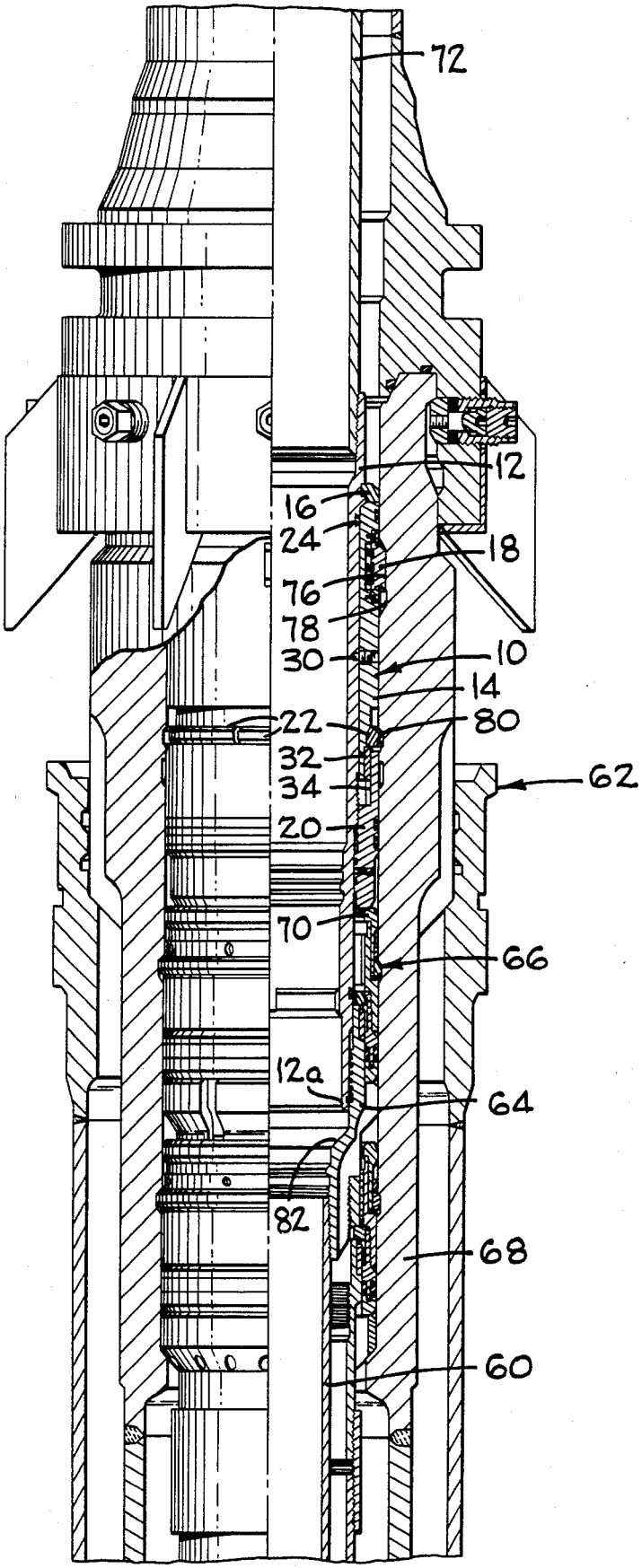
FIG. 3 is a side elevation, on a reduced scale and with parts broken away, of the connector of FIG. 1 attached to a casing riser and in landed position in a subsea wellhead.
Figure 4:
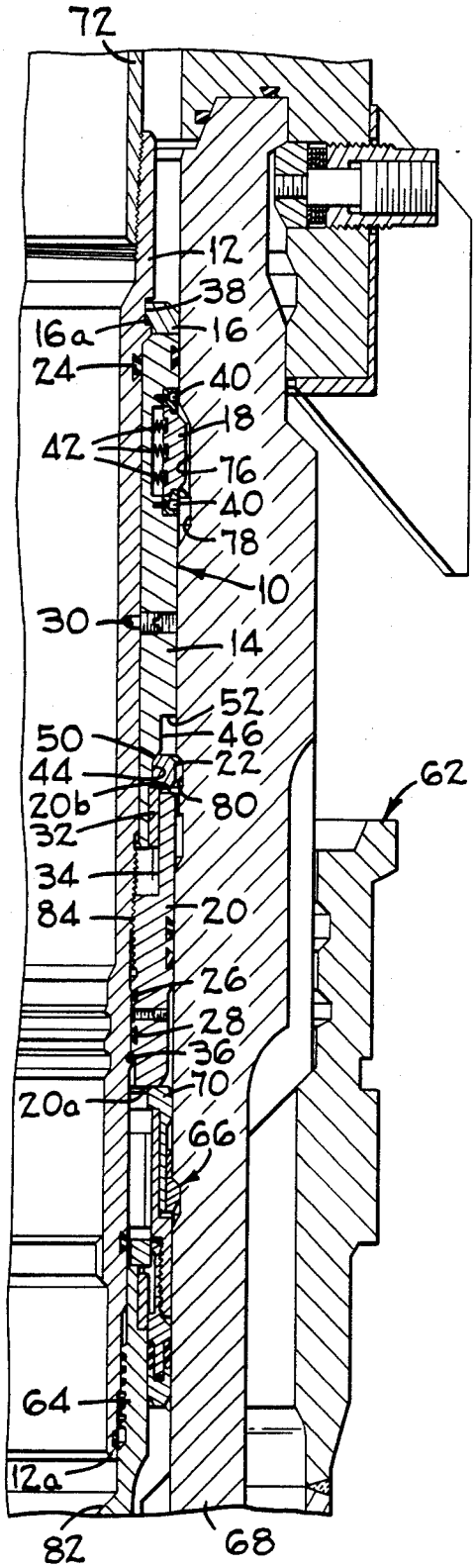
FIG. 4 is an enlarged fragmentary view of the connector and wellhead as shown in FIG. 3.
Figure 5:
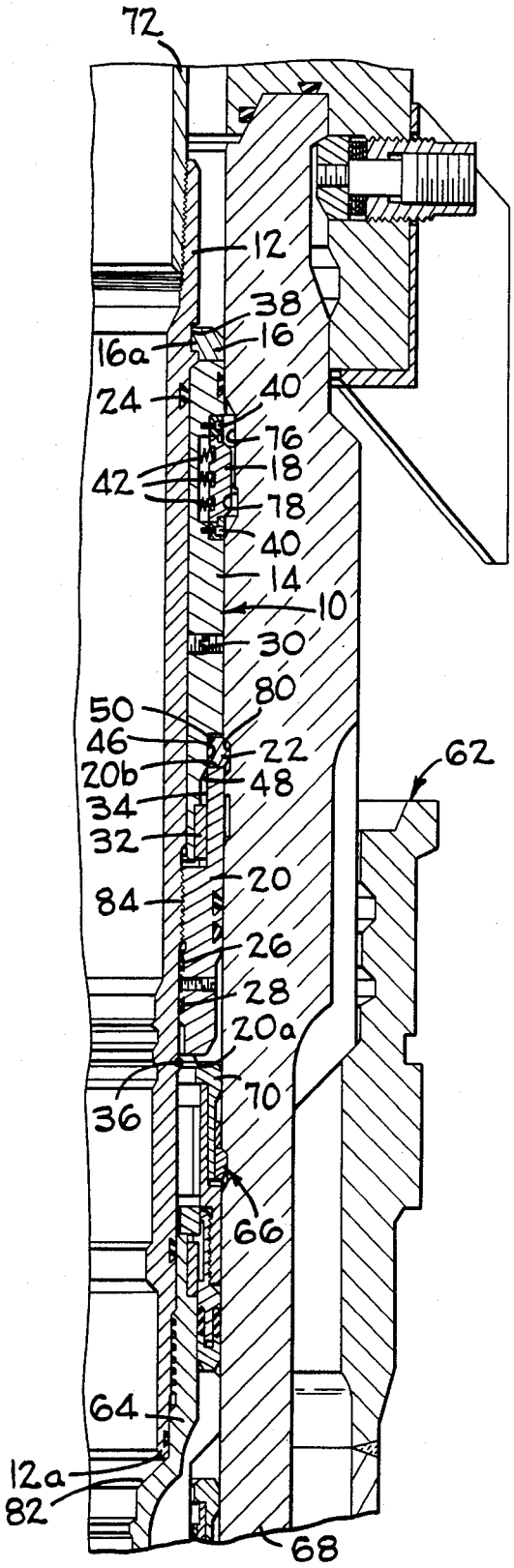
FIG. 5 is a view like FIG. 4, but showing the connector in its final position wherein it is locked to the wellhead.

The connector 10 is designed especially for tying back to a string of well casing 60 in a subsea wellhead, such as for example the wellhead 62 illustrated in FIGS. 3–5. As seen in FIG. 3, the casing 60 is supported in the wellhead 62 by a fluted casing hanger 64, and a packoff assembly 66 provides a fluid pressure seal between the hanger 64 and the adjacent larger-diameter casing hanger 68, all in a conventional manner. The packoff assembly 66 includes an annular locking mandrel 70 upon which the lower end surface 20*a* of the connector actuator nut 20 comes to rest when the connector 10 is run into the wellhead 62 by means of a casing riser 72 to which the upper end of the connector sub 12 is threaded, as at 74.

Accordingly, and as seen better in FIG. 4, in making up the connection between the casing 60 and the riser 72 the connector 10 is lowered into the casing hanger 68 until the actuator nut 20 seats on the packoff locking mandrel 70. The casing riser 72 is then rotated, thereby likewise rotating the connector 10, until the anti-rotation keys 18 pop out from their inner position (not shown) into axial slots 76 (one shown) in an annular groove 78 in the bore of the hanger 68, thereby preventing further rotation of the collar 14 and also the actuator nut 20 which, as described above, are anti-rotationally interconnected by the keys 32 and slots 34.

The casing riser 72 is then rotated further, shearing the pin 30 and rotating the sub 12 with respect to the collar 14 and nut 20. As this rotation continues the sub 12 and the collar 14 move downwardly with respect to the nut 20 and the lock ring 22, thereby causing the collar's cam surface 48 to cam the ring outwardly into an annular groove 80 in the bore of the hanger 68, and then positioning the collar's upper annular surface 46 behind the ring to lock it in its expanded condition as shown in FIG. 5.

Further rotation of the casing riser 72 and the sub 12 next causes the lower end or nose 12*a* of the sub to contact an annular stop shoulder 82 in the bore of the hanger 68, thereby preventing further downward travel of the sub. Continued rotation and the threaded connection 84 between the sub 12 and the actuator nut 20 combine to force the nut to rise off the packoff locking mandrel 70 and move upwardly until its upper end 20*b* bears against the lock ring 22. Additional torquing of the casing riser 72 creates forces that are applied through the actuator nut 20 and the expanded lock ring 22 to the shoulder 82*a* of the hanger groove 80, and when these forces load-up, due to frictional co-efficients, a reactive force is simultaneously and equally applied through the sub's nose 12*a* to the hanger's stop shoulder 82. As illustrated in FIG. 5, this results in interlocking the connector 10 and the hanger 68, and also in establishing a pressure-tight metal-to-metal seal between the sub's nose 12*a* and the hanger's stop shoulder 82.

Unlocking the connector 10 from the hanger 68, such as for subsequent removal of the connector from the wellhead, is readily accomplished by rotation of the riser 72 in the opposite direction. This rotation relaxes the forces, moves the actuator nut 20 back to its original stop position on the packoff locking mandrel 70, and then causes the sub 12 to move upwardly. As the sub's annular surface 44 arrives at the level of the lock ring 22 the ring contracts into its original position as shown in FIGS. 1, 3 and 4, whereupon the connector 10 can then be retrieved from the wellhead simply by lifting on the riser 72.

Among the several advantageous features of a connector according to the present invention is that no tooling, other than the casing, tubing or other pipe string to which the connector is attached, is required to run, retrieve, activate, or engage the connector, although other tools could be incorporated with the connector if desired. Furthermore, all anti-rotation effects originate in a slotted groove within the casing hanger or other receptacle at a level near the upper end of the landed and locked connector, rather than in a packoff or downhole mandrel where rotation could be detrimental. Another uncomplex and desirable feature exists in the method of actuation: only direct rotation, either right-hand or left-hand, is required to make-up the connection, and simple rotation in the opposite direction achieves full release of the connector from the receptacle.

Although the best mode contemplated for carrying out the present invention has been herein shown and described, it will be apparent that modification and variation may be made without departing from what is regarded to be the subject matter of the invention as set forth in the appended claims.

I claim:

1. A pipe connector especially useful for tying back to a subsea wellhead with a casing riser, said connector comprising:

a. a tubular tieback sub;

b. a sleeve-like collar surrounding the sub;

c. anti-rotation means for releasably securing the collar to a receptacle in which the connector is installed;

d. an actuator nut surrounding the sub;

e. means interconnecting the sub and the nut to facilitate relative axial movement between said sub and nut in response to rotation of said sub with respect to said nut;

f. means interconnecting the collar and the nut to facilitate relative axial movement and prevent relative rotational movement therebetween; and g. lock ring means surrounding the collar and expandable from a contracted condition by axial movement of the collar with respect to said nut.

2. A pipe connector according to claim 1 including retainer means interconnecting the collar and the sub preventing relative axial movement therebetween.

3. A pipe connector according to claim 2 wherein said retainer means comprises a plurality of arcuate ring segments, each segment having means for securing said segment to the sub, and means for securing said segments to the collar.

4. A pipe connector according to claim 1 including shearable means interconnecting the collar and the sub to prevent relative rotation therebetween.

5. A pipe connector according to claim 1 wherein the anti-rotation means comprises at least one key carried by the collar in a radially movable manner, and means resiliently biasing said key toward its fully extended position.

6. A pipe connector according to claim 5 including four keys, and wherein the resiliently biasing means comprise coil springs.

7. A pipe connector according to claim 1 wherein the means interconnecting the collar and the nut comprise at least one anti-rotation key and at least one anti-rotation slot for cooperation with said key.

8. A pipe connector according to claim 7 wherein the anti-rotation key extends from the lower end portion of the collar, and the anti rotation slot resides in the upper end portion of the nut.

9. A pipe connector according to claim 1 wherein the means interconnecting the sub and the nut comprise threads.

10. A pipe connector according to claim 9 wherein rotation of the sub with respect to the nut causes the collar to move axially toward the nut and expand the lock ring means.

11. A pipe connector according to claim 1 wherein the sub includes a first annular surface against which the lock ring means resides when in its contracted condition, a second annular surface about which said lock ring mans resides when in its fully expanded condition, and an annular cam surface intermediate to and interconnecting said first and second annular surfaces.

12. A pipe connector according to claim 11 wherein said second annular surface functions to lock said lock ring means in its expanded condition.

13. A pipe connector according to claim 1 wherein the anti-rotation means is located at the upper end portion of the collar, the upper end portion of the actuator nut engages the lower end portion of the collar, and the lock ring means in its contracted condition resides against a first annular surface on the collar above the actuator nut.

14. A pipe connector according to claim 13 wherein rotation of the sub with respect to the collar and the nut causes expansion of the lock ring means and its ultimate positioning on a second annular surface on the collar.

15. A pipe connector according to claim 14 wherein said second annular surface locks the lock ring means in an expanded condition.

16. A pipe connector according to claim 1 wherein the collar includes a first annular surface against which the lock ring means resides in a contracted condition, a second annular surface about which the lock ring means resides in an expanded condition, an annular cam surface intermediate said first and second annular surfaces, and a radial stop surface axially spaced from said cam surface and extending radially from said second annular surface.

* * * * *